US006189597B1

(12) United States Patent
Cheng

(10) Patent No.: US 6,189,597 B1
(45) Date of Patent: Feb. 20, 2001

(54) HANGER RING ASSEMBLY FOR CURTAIN

(76) Inventor: Wen Ping Cheng, 829 Shadymoss, Walnut, CA (US) 91789

( * ) Notice: Under 35 U.S.C. 154(b), the term of this patent shall be extended for 0 days.

(21) Appl. No.: 09/418,172

(22) Filed: Oct. 13, 1999

(51) Int. Cl.[7] ..... A47H 13/00
(52) U.S. Cl. ..... 160/383; 160/330; 24/716
(58) Field of Search ..... 160/330, 84, 348, 160/370.22, 382, 383; 24/713.6, 114.3, 716, 600.09; 16/87.2, DIG. 16

(56) References Cited

U.S. PATENT DOCUMENTS

| | | | |
|---|---|---|---|
| 3,118,207 | 1/1964 | Breslow | 160/DIG. 16 X |
| 3,388,734 | 6/1968 | Silvestre | 160/348 |
| 4,031,943 | 6/1977 | Silvestre | 160/330 |
| 6,006,406 | 12/1999 | Chung | 24/713.6 |

*Primary Examiner*—Daniel P. Stodola
*Assistant Examiner*—Hugh B. Thompson
(74) *Attorney, Agent, or Firm*—Raymond Y. Chan; David and Raymond

(57) ABSTRACT

A curtain with a hanger ring assembly for mounting onto a supporting rod includes a sheet material and a plurality of hanger units. The sheet material has a plurality of hanger openings formed along a top edge, and a plurality of edge gap each extending from the top edge to an upper portion of the respective hanger opening. Each of the opening portions defines a section of connecting tab adjacent to the respective edge gap. Each of the hanger units includes a hanger ring which has a ring slit separating two ends thereof and defines a section of ring tab adjacent to the ring slit. Each of the hanger rings is attached to one side of the respective opening portion and coaxially extended around the respective hanger opening with the ring slit of the respective hanger ring staggering with the edge gap of the respective opening portion. The connecting tabs of the opening portions of the sheet material are detachably overlapped with the ring tabs of the hanger rings respectively. Each of the hanger units further includes a connecting device for selectively connecting each of the ring tabs with the respective connecting tab. Accordingly, the hanger ring assembly not only enables the curtain to be directly mounted onto a supporting rod without the need of additional hook or clip members nor the need of taking down the rod, but also prevents any cuts between the hanger openings on the curtain.

8 Claims, 10 Drawing Sheets

HANGER RING ASSEMBLY FOR CURTAIN

BACKGROUND OF THE PRESENT INVENTION

1. Field of Invention

The present invention relates to an arrangement for hanging a curtain to a supporting rod, and more particularly to a hanger ring assembly adapted for mounting a curtain onto a supporting rod.

2. Description of Related Arts

Curtains and the like such as drapes and portieres are common used for sheltering windows, shower areas, separating spaces, and etc. Most of the curtains are hanged by supporting rods or rod-like elements, each of which is solid or hollow elongated object having a uniform cross section. Curtains can be made of flexible sheet materials such as plastic or resin. Woven fabric or the like, or non-woven fabric or the like, or water resistant paper, or sheet metal, or woven metal strands or rods are other commonly known materials for making curtains.

The conventional methods of mounting a curtain onto a supporting rod include hook or clip method and ring method. If the two ends of the supporting rod are permanently affixed to two opposite walls, a plurality of J-shaped or S-shaped hook members are spacedly connected along a top edge of the curtain for hooking onto the supporting rod, or alternatively, a plurality of clip members are penetrated into the curtain for attaching directly to the supporting rod or to rings attached to the supporting rod.

If the supporting rod is supported between the two opposite walls in a detachable manner, a plurality of hanger rings are spacedly affixed along the top edge of the curtain, wherein the user must penetrate the supporting rod through the hanger rings before mounting the supporting rod between the two walls, so that the curtain is hanged up by the supporting rod. Also, in order to replace the curtain, the user must take down the supporting rod that causes a lot of trouble and time.

In order to rapidly mount a curtain onto a rod, U.S. Pat. No. 5,186,232 suggests communication between the openings in each pair of openings which are spacedly provided along a top edge of the curtain. The communication, in fact, contains an open path, such as a cut, between the two openings in a pair which enables the engagement of the curtain onto the rod directly without the need of the additional hook or clip members nor the need of taking down the rod. In other words, when mounting the curtain on the rod, the portion of the curtain between the pairs of openings in each pair are pushed to the other side of the rod by passing the rod through the cuts.

However, the plurality of cuts formed on the curtain largely weakens the material strength of the curtain and reduce the service life span of the curtain. Due to the weight of the curtain itself when it is hanged down, the curtain will be torn at the junctions of the cuts and openings. Moreover, when the user pulls the curtain mounted on the rod while spreading or gathering the curtain, a relatively large pulling force will be applied to the curtain that may easily pull pair of openings detaching from the rod through the respective cut extended between pair of openings. Also, the plurality of cuts provided between pairs of openings also render the spreading or gathering operation of the curtain along the rod becoming difficult because the pulling force applied to the curtain will not be evenly distributed around the rings. The junctions of the cuts and the openings will also cause resistance when moving the curtain along the rod. Besides, the appearance and the design of the curtain will be adversely affected by the existence of cuts thereon.

SUMMARY OF THE PRESENT INVENTION

Accordingly, it is a main object of the present invention to provide a hanger ring assembly for curtain that not only enables the curtain to be directly mounted onto a supporting rod without the need of additional hook or clip members nor the need of taking down the rod, but also prevents any cuts between the hanger openings on the curtain.

It is another object of the present invention to provide a hanger ring assembly for curtain, which enables the mounting of the curtain onto the supporting rod being a lot faster and easier. For example, an adult may hang up a shower curtain according to the present invention within 12 seconds.

It is another object of the present invention to provide a hanger ring assembly for curtain, wherein since no cut is provided between the hanger openings of the curtain, the appearance and design of the curtain can be perfectly reserved.

It is another object of the present invention to provide a hanger ring assembly for curtain, wherein when each pair of the hanger rings of the hanger unit is assembled, no gap, slit or cut is formed, so that the weight of the hanging curtain will be evenly distributed around the hanger openings, so as to enable smooth spreading or gathering movement of the curtain when a pulling force is applied thereto.

It is another object of the present invention to provide a hanger ring assembly for curtain, wherein each of the hanger units may consist of a pair of hanger ring and engagement ring respectively and coaxially connected to both sides of the hanger openings of the curtain so as to provide a more rigid and durable structure to support the curtain onto the supporting rod.

It is another object of the present invention to provide a hanger ring assembly for curtain, wherein by eliminating the conventional hook or clip members, it not only can reduce its manufacturing cost, but also can provide a more neat appearance.

In order to accomplish the above objects, the present invention provides a curtain with a hanger ring assembly for mounting onto a supporting rod, comprising

- a sheet material, which has a top edge, a plurality of opening portions spacedly formed along the top edge, a plurality of hanger openings provided on the opening portions respectively, and a plurality of edge gap each extending from the top edge to an upper portion of the respective hanger opening, wherein each of the opening portions defines a section of connecting tab adjacent to the respective edge gap; and
- a plurality of hanger units each comprising:
  - a hanger ring which has a ring slit separating two ends thereof and defines a section of ring tab adjacent to the ring slit, wherein each of the hanger rings is attached to one side of the respective opening portion and coaxially extended around the respective hanger opening with the ring slit of the respective hanger ring staggering with the edge gap of the respective opening portion, wherein the connecting tabs of the opening portions of the sheet material are detachably overlapped with the ring tabs of the hanger rings respectively, adapted for enabling the hanger rings mounting onto the supporting rod through the ring slit and the edge gaps respectively; and means for selectively connecting each of the ring tabs with the respective connecting tab.

In order to better reinforce the hanger rings to support the sheet material onto the supporting rod, each of the hanger units further comprises an engagement ring which has an end slit separating two ends thereof, wherein the engagement rings are respectively attached on another sides of the opening portions and coaxially aligned with the hanger rings respectively with the end slits thereof respectively aligned with the edge gaps of the opening portions of the sheet material so as to reinforce and better support the hanger openings.

DETAILED DESCRIPTION OF THE PREFERRED EMBODIMENTS

Figure 1:
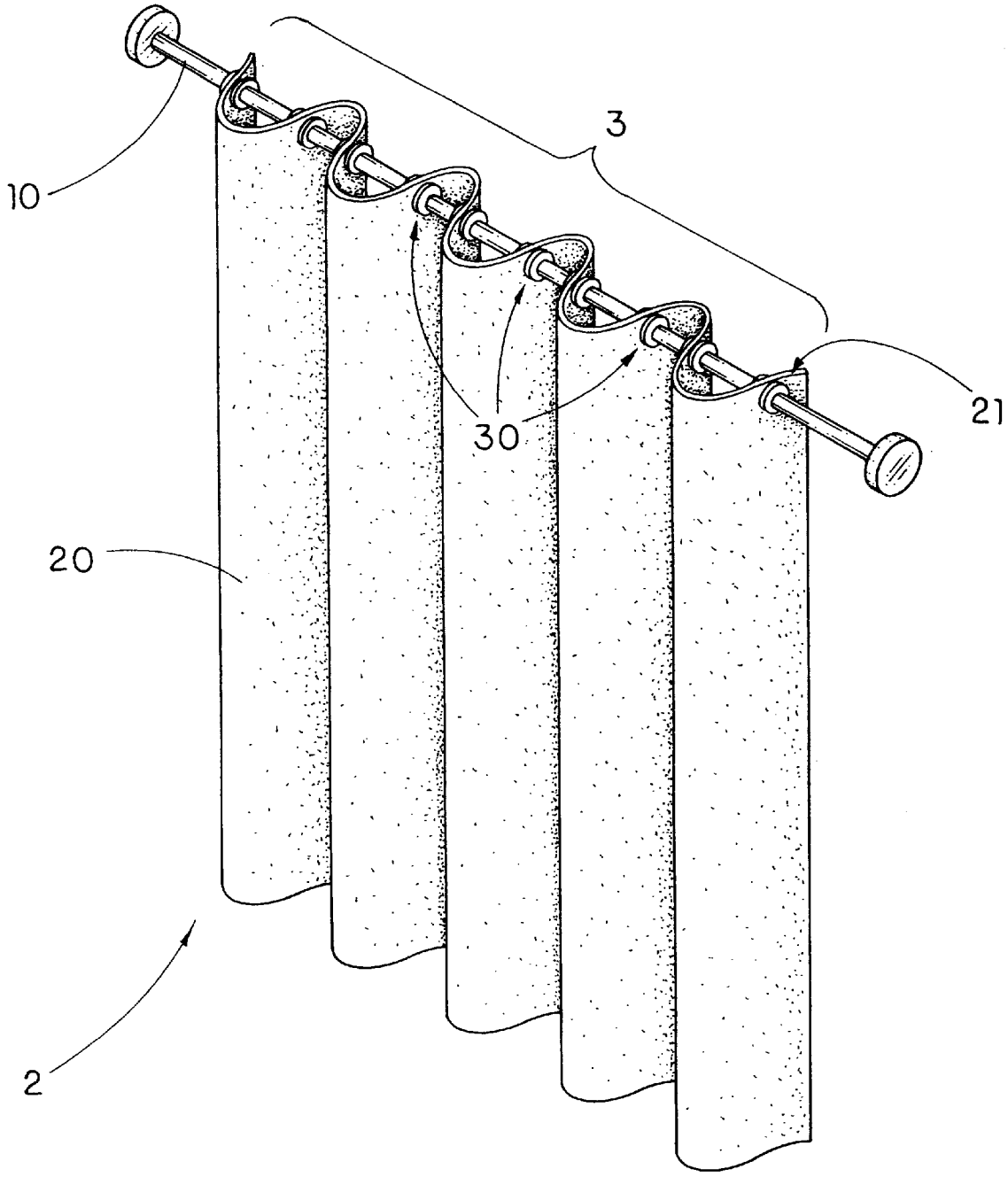
FIG. 1 is a perspective view of a hanger ring assembly for curtain according to a first preferred embodiment of the present invention.

Referring to FIGS. 1 to 4, a curtain 2 having a hanger ring assembly 3 adapted for mounting onto a supporting rod 10 is illustrated, wherein the term "curtain" in the present invention refers to sheet material functioned as window curtain, separation curtain, shower curtain, drape, portiere, or the like. The curtain 20 comprises a sheet material 20 made of flexible materials such as plastic or resin, or woven fabric or the like, or non-woven fabric or the like, or water resistant paper, or sheet metal, or woven metal strands or rods are other commonly known materials for making curtains.

The sheet material 20 which has a top edge 21 which can be reinforced by an elongated lining layer 22. The top edge 21 of the sheet material 20 further divided into a plurality of opening portions 23 spacedly formed along the top edge 21, a plurality of hanger openings 24 provide on the opening portions 23 respectively, and a plurality of edge gap 25 each extending from the top edge 21 to an upper portion of the respective hanger opening 24, wherein each of the opening portions 23 defines a section of connecting tab 231' or 231" adjacent to the respective edge gap 25.

Figure 2:
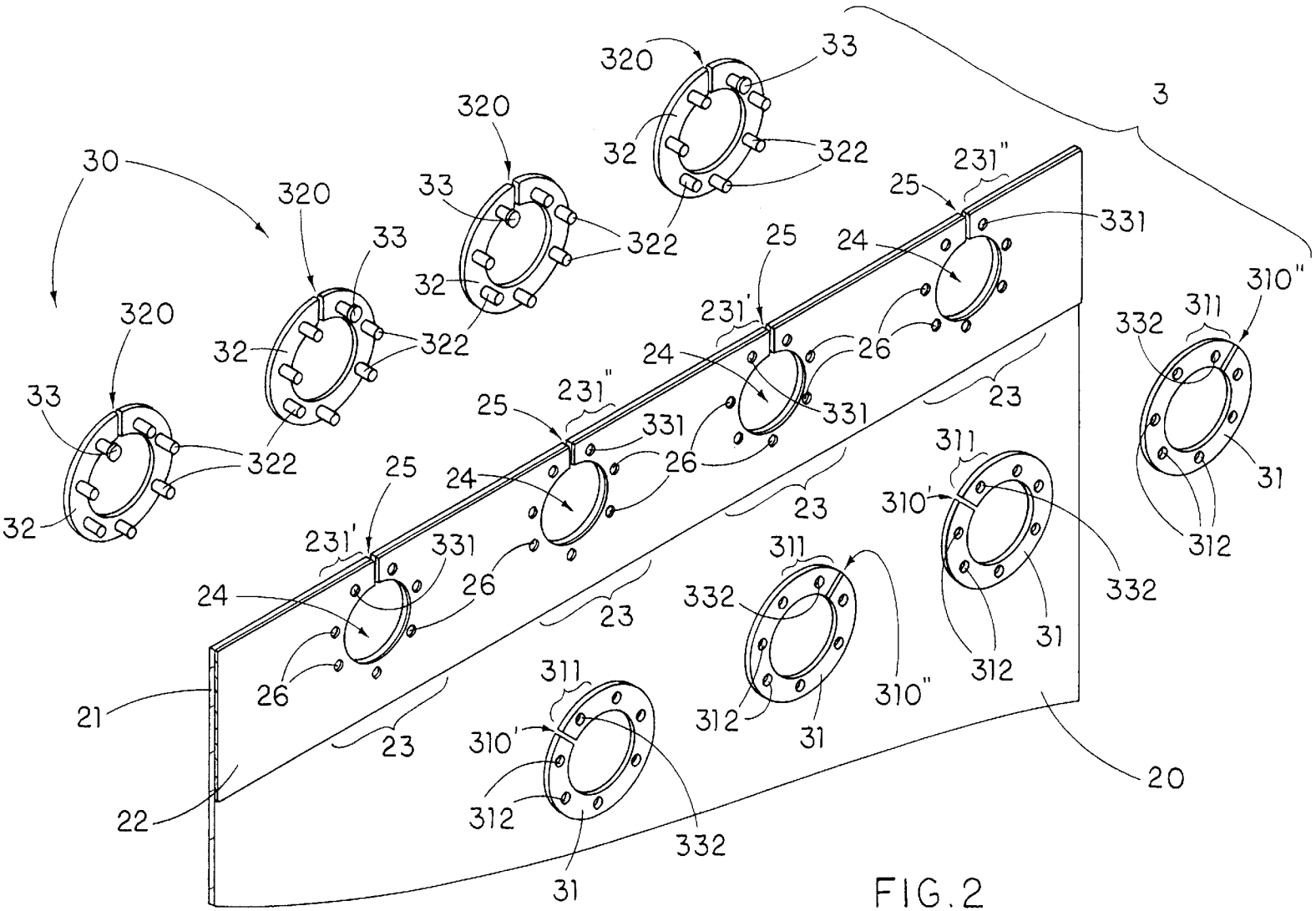
FIG. 2 is an exploded perspective view of part of the hanger ring assembly according to the above first preferred embodiment of the present invention.

The hanger ring assembly 3 of the curtain 2 comprises a plurality of hanger units 30 each of which comprises a pair of hanger ring 31 and engagement ring 32. Each of the hanger rings 31 has a ring slit 310' or 310" separating two ends thereof and defines a section of ring tab 311 adjacent the ring slit 310' or 310". As shown in FIG. 2, the ring slit 310' or 310" is a radial through cut from outer side to inner side of the hanger ring 31. According to the present first embodiment, the hanger rings 31 are positioned and divided into pairs manner, wherein the ring slit 310' of the first hanger ring 31 of each pair of hanger rings is positioned 15° to 30° anticlockwise from vertical, while the ring slit 310" of the second hanger ring 31 of each pair of hanger rings is symmetrically positioned 15° to 30° clockwise from vertical. Correspondingly, as shown in FIG. 2, the connecting tabs 231' and 231" in respect with each pair of hanger rings 31 are respectively positioned at the left and right portions of the edge gap 25.

Figure 3:
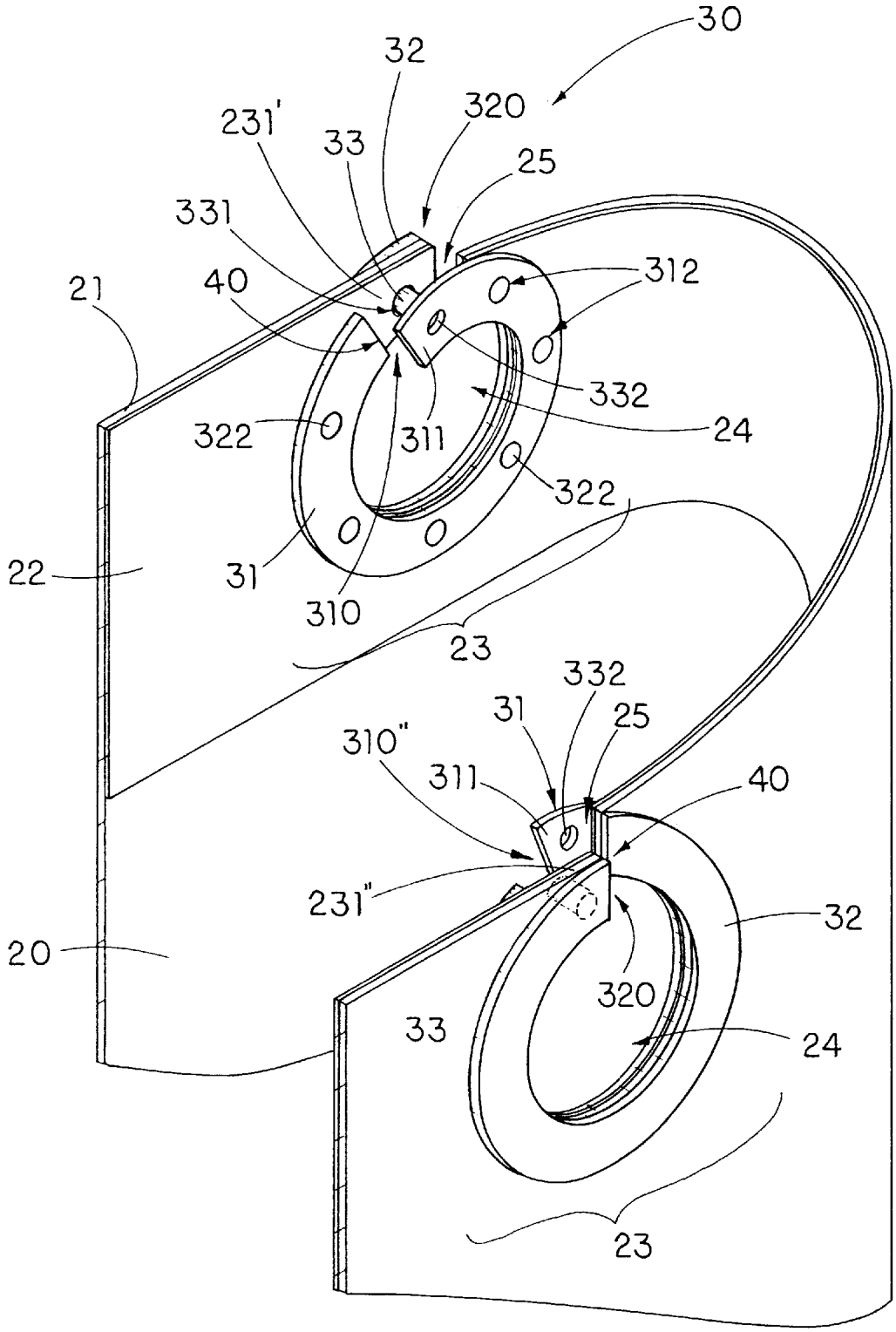
FIG. 3 is a partial perspective view of the hanger ring assembly according to the above first preferred embodiment of the present invention.

As shown in FIGS. 2 and 3, each of the hanger rings 31 is attached to one side of the respective opening portion 23 and coaxially extended around the respective hanger opening 24 with the ring slit 310' or 310" of the respective hanger ring 31 staggering with the edge gap 25 of the respective opening portion 23. Therefore, the connecting tabs 231' and 231" of the opening portions 23 of the sheet material 20 are detachably overlapped with the ring tabs 311 of the hanger rings 31 respectively, so as to enable the hanger rings 31 mounting onto the supporting rod 10 through the ring slits 310' and 310" and the edge gaps 25 respectively.

According to the first preferred embodiment as mentioned above, the plurality of engagement rings 32 are provided to better reinforce the hanger rings 31 to support the sheet material 20 onto the supporting rod 10, espacially when a heavier sheet material is used to made the curtain. Each of the engagement rings 32 has an end slit 320 separating two ends thereof, wherein the engagement rings 32 are respectively attached on another sides of the opening portions 23 and coaxially aligned with the hanger rings 31 respectively with the end slits 320 thereof respectively aligned with the edge gaps 25 of the opening portions 23 of the sheet material 20 so as to reinforce and better support the hanger openings 24.

The hanger rings 31 as well as the engagement rings 32 can be simply glued to the both sides of the opening portions 23 respectively. Alternatively, if plastic made hanger rings 31 and engagement rings 32 are structured with PVC made sheet material, the hanger rings 31 and the engagemnet rings 32 can be attached to the opening portions 23 of the sheet material by ultrasonic welding. However, according to the first preferred embodiment of the present invention, as shown in FIG. 2, no matter what kinds of material are used, the hanger rings 31 are directly connected with the engagement rings 32 with the sheet material 20 firmly engaged therebetween. To achieve such result, a pluarlity of engagement holes 26 are formed around each of the hanger openings 24 of the opening portions 23. Also, each of the hanger rings 31 is provided with a plurality of connection holes 312 which are coaxially aligned with the engagement holes 26 of each respective hanger opening 24. Moreover, an inner surface of each of the engagement rings 32 is provided with a pluarlity of protrusions 322 aligned coaxially with the connection holes 312 of the hanger rings 31 respectively.

Therefore, by firmly plugging the protrusions 322 of each enagement rings 32 through the engagement holes 26 of the respective opening portion 23 into the connection holes 312 of the respective hanger ring 31 can more firmly connect the engagement rings 32 and the hanger rings 31 together, so as to more firmly engage and support the sheet material 20 between the hanger rings 31 and the engagement rings 32, as shown in FIGS. 1 and 3.

Furthermore, if both the hanger rings 31 and the engagement rings 32 are made of plastic material, the manufacturers can further united the hanger ring 31 with the respective engagement ring 31 by applying ultrasonic welding to integrally weld the protrusions of the engagement ring 32 with the hanger ring 31. Certainly, the protursions 322 can also be projected from the inner surface of the hanger rings 31 while the connection holes 312 are alternatively provided on the engagement rings 32. Similar connection effect can be achieved.

The hanger ring assembly 3 of the present invention further comprises a plurality of means for selectively connecting each of the ring tabs 311 with the respective connecting tab 231' or 231". As shown in FIGS. 2 and 3, according to the first preferred embodiment, each connecting means comprises a connecting plug 33 protruded from a position near the end slit 320 of the engagement ring 32 and penetrated through the respective opening portion 23 via a tab hole 331 provided near the edge gap 25. Moreover, each of the hanger rings 31 also symmetrically provides a locking hole 332 on the ring tab 311 thereof. Therefore, the connecting plugs 33 are adapted to firmly plug into the locking holes 332 respectively so as to rigidly connecting the ring tabs 311 and the connection tabs 231' and 231" together.

Figure 4:
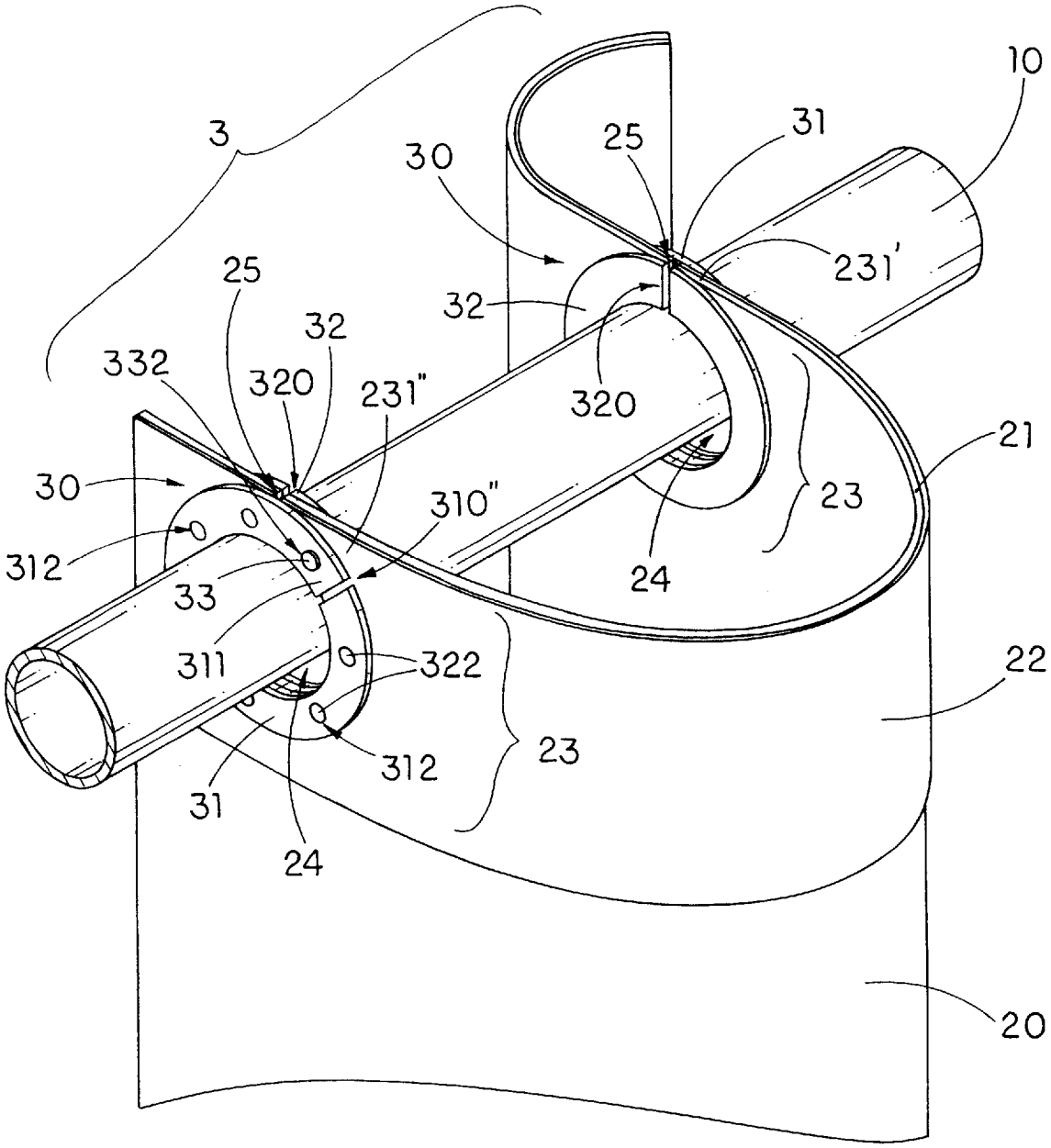
FIG. 4 is a partial perspective view illustrating how the curtain mounting onto a supporting rod according to the above first preferred embodiment of the present invention.

As shown in FIG. 3, in order to mount the curtain 2 onto the supporting rod 10, the ring tabs 311 of the hanger rings 31 are move apart from the connection tabs 231', 231" of the opening portions 23 by detaching the connecting plugs 33 from the locking holes 332 respectively in order to define an entrance gap 40 between each of the connection tabs 231', 231" and the respective ring tabs 311. Accordingly, as shown in FIGS. 3 and 4, the supporting rod 10 can be placed in hanger openings 24 through the entrance gaps 40. In other words, the hanger units 30 can mount on the supporting rod 10 through the entrance gaps 40. Then, close the entrance gaps 40 by respectively re-plugging the connecting plugs 33 into the locking holes 332. The re-connection of the ring tabs 311 with the connecting tabs 231', 231" can construct each of the hanger rings 31 and the respective engagement ring 32 together to form an integral ring structure for evenly supporting the sheet material 20 on the supporting rod 10, as shown in FIG. 4.

It is worth to mention that the first embodiment illustrates a preferred mode that the hanger rings 31 are provided in pairs. As shown in FIG. 2, in each pair of hanger rings 31, one of the hanger rings 31 makes its ring slit 310' positioned at left side with respect to the vertical edge gap 25 while another hanger ring 31 makes its ring slit 310" positioned at right side with respect to the vertical edge gap 25. As shown in FIGS. 1 and 3, since the sheet material 20 is mounted onto the supporting rod 10 in a continuous "S" manner, such arrangement enables the ring slits 310' and 310" to be positioned at the same side, that can facilitate the mounting of the the hanger units 30 onto the supporting rod 10. Moreover, as shown in FIG. 1, the movement of the curtain 2 along the supporting rod 10 will be more smoothly when all the ring slits 310' and 310" of the hanger rings 31 are symmetrically located at the same direction.

In view of above, the present invention can substantially achieve the following advantages:

1. The present invention not only enables the curtain 2 to be directly mounted onto the supporting rod 10 without the need of additional hook or clip members nor the need of taking down the rod, but also prevents any cuts between the hanger openings 24 on the curtain 2.

2. The hanger ring assembly 3 enables the mounting of the curtain 2 onto the supporting rod 10 being a lot faster and easier. For example, an adult may hang up a shower curtain according to the present invention within 12 seconds.

3. Since no cut is provided between the hanger openings 24 of the curtain 2, the appearance and design of the curtain 2 can be perfectly reserved.

4. When each pair of the hanger rings 31 of the hanger unit 30 is assembled, no gap, slit or cut is formed, so that the weight of the hanging curtain 2 will be evenly distributed around the hanger openings 24 that can enable smooth spreading or gathering movement of the curtain 2 when a pulling force is applied thereto.

5. Each of the hanger units 30 consists of a pair of hanger ring 31 and engagement ring 32 which are respectively and coaxially connected to both sides of the hanger openings 24 of the curtain 2 so as to provide a more rigid and durable structure to support the curtain 2 onto the supporting rod 10.

6. By eliminating the conventional hook or clip members, the present invention not only can reduce its manufacturing cost, but also can provide a more neat appearance.

Base on the inventive concept suggested above, a plurality of obvious modifications are illustrated in FIGS. 5 to 10 and described as follows.

Figure 5:
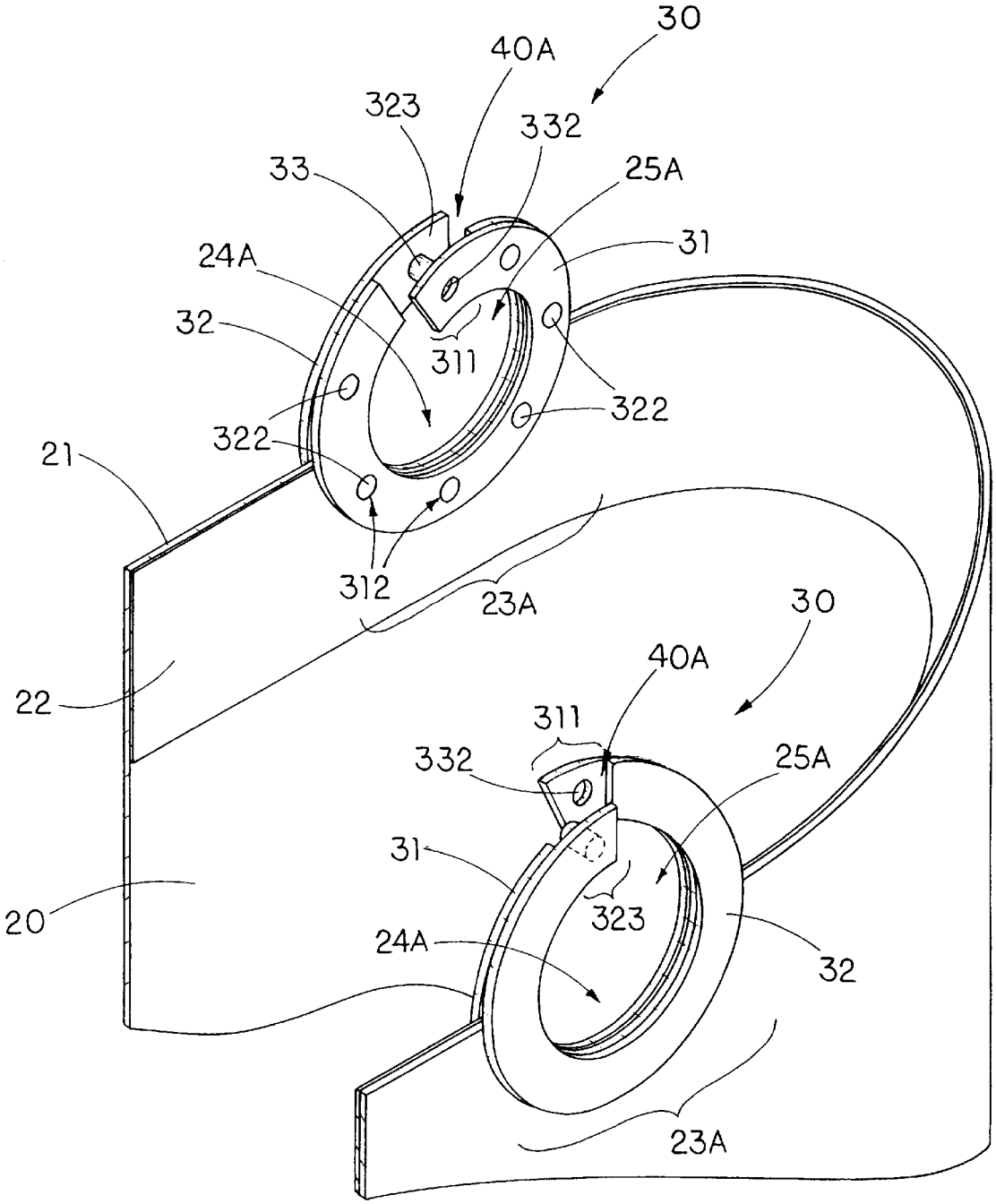
FIG. 5 is a partial perspective view of an alternative mode of the above first preferred embodiment of the present invention.
Figure 6:
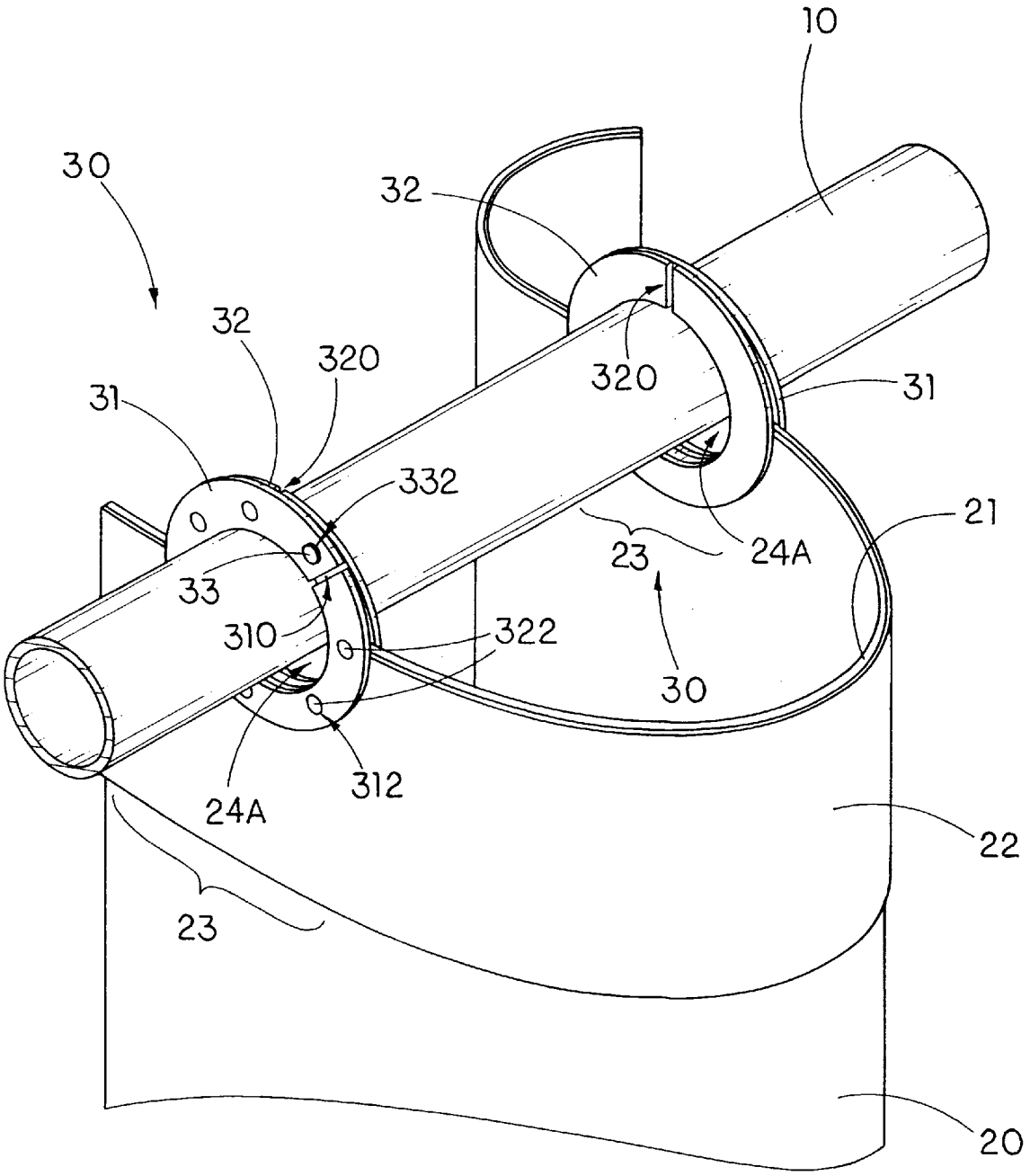
FIG. 6 is a partial perspective view illustrating how the curtain mounting onto a supporting rod according to the above alternative mode of the above first preferred embodiment of the present invention.

As shown in FIGS. 5 and 6, an alternative mode of the above first preferred embodiment is illustrated, wherein the hanger ring assembly 3 is basically identical to that disclosed in FIGS. 1 to 4, except that the top edge 21 of the sheet material 20 merely extended to a half height of the hanger units 30. Therefore, the circular hanger openings 24 in the first embodiment become semi-circular shaped hanger openings **24*a* and the edge gaps 25 of the opening portions 23 in the above first embodiment become the top openings 25*a* of the opening portions 23*a* respectively. Moreover, the connecting tabs 231', 231" in the above first embodiment are substituted by the engaging tabs 323 of the engagement rings 32, which are detachably overlapped with the ring tabs 311 of the hanger rings 31 respectively. Therefore, by separating the ring tabs 311 with the connecting tabs 323 (i.e. the engaging tabs of the engagement rings 32) can open the entrance gaps 40*a* to enable the hanger rings 31 and the engagement rings 32 of the hanger units 30 mounted onto supporting rod 10. Re-plug the connecting plugs 33 into the locking holes 332 can close up the entrance gaps 40*a* and reconnect each of the hanger rings 31 and the respective engagement ring 32 to form an integral ring structure for supporting the sheet material 20 on the supporting rod 10, as shown in FIG. 6**.

Figure 7:
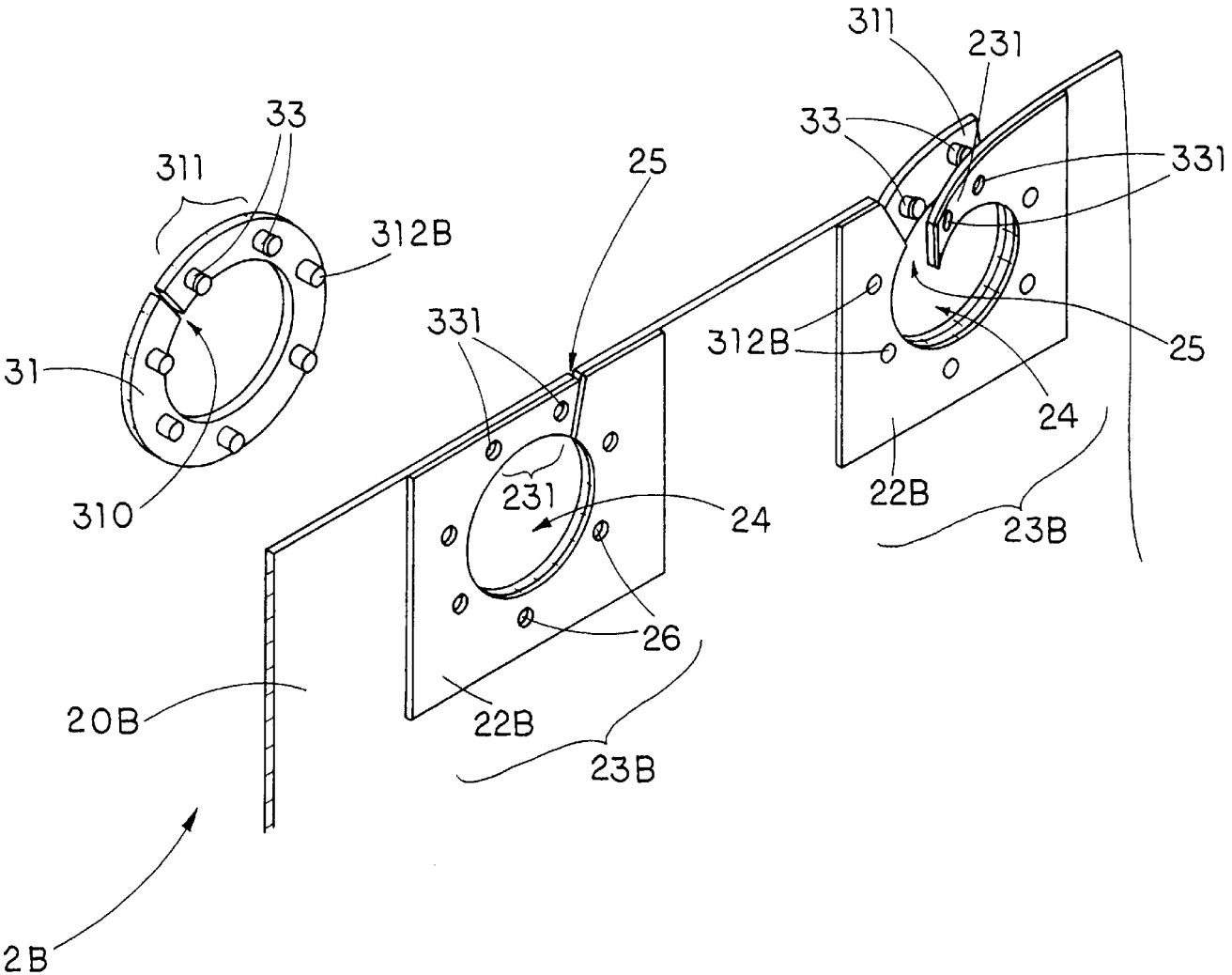
FIG. 7 is a partially exploded perspective view of a hanger ring assembly according to a second preferred embodiment of the present invention.

Referring to FIG. 7, a second preferred embodiment of the present invention is illustrated, which is suitable for curtain **2*b*, such as shower curtain, having a light weight sheet material 20*b* such as a thin PVC material. In which, the engagement rings 32 as described in the first embodiment are eliminated or substituted by a reinforced lining pads 22*b* positioned on the opening portions 23*b* respectively. Each of the opening portions 23*b* also has an edge gap 25 and defines a connecting tab 231 adjacent the edge gap 25, wherein at least one tab hole 331 is formed on the connecting tab 231. Similarly, each of the hanger rings 31 also has a ring slit 310 positioned and defines a ring tab 311 adjacent the ring slit 310**.

The hanger rings 31 are respectively attached to the opening portions 23*b* and coaxially positioned around the hanger openings 24 provided on the opening portions 23*b* with each of the ring slits 310 staggering with the respective edge gap 25 so as to detachably overlap the ring tabs 311 with the connecting tabs 231 respectively. At least one connecting plug 33 is projected from the ring tab 311 adapted for detachably engaging with the respective tab hole 331 provided on the connecting tab 231 for closing up the entance gap formed between the ring slit 310 and the edge gap 25 so as to mount the hanger rings 31 onto the supporting rod.

Similarly, in order to further enhance the adhesive connection between hanger rings 31 and the sheet material 20*b*, a plurality of protrusions 312*b* are spacedly projected from each of the hanger rings 31, which are adapted for engaging in a pluarlity of engagement holes 26 provided around the respective hanger openings 24.

Figure 8:
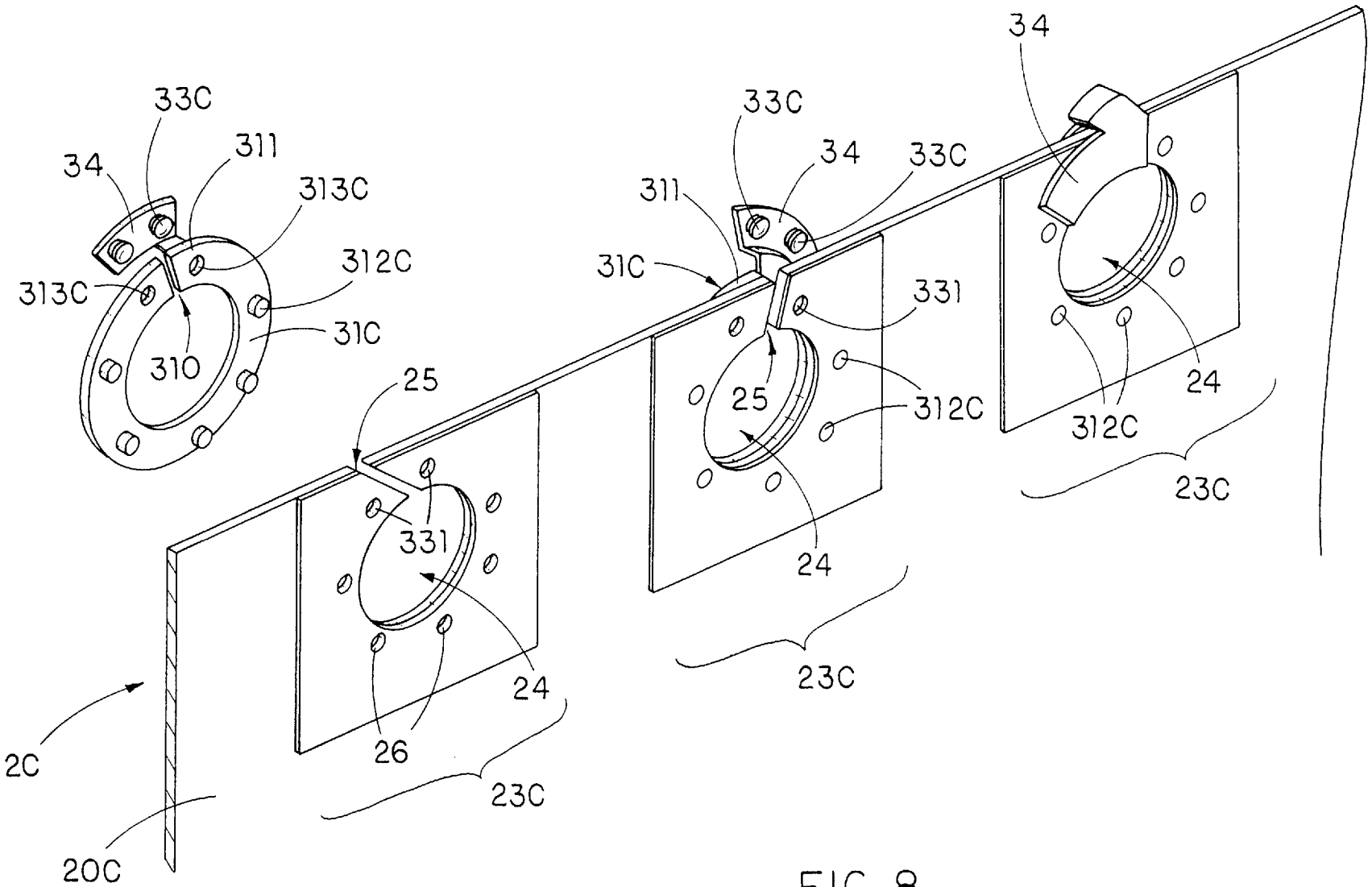
FIG. 8 is a partially exploded perspective view of a hanger ring assembly according to a third preferred embodiment of the present invention.

FIG. 8 illustrates a third preferred embodiment of the present invention, which is also suitable for curtain 2*c* having a light weight sheet material 20*c*. This third preferred embodiment is similar in structure with the above second embodiment except that the connecting means comprises an engagement wing 34 integrally extended from the ring tab 311 of each of the hanger rings 31*c*, which is attached around the respective hanger opening 24 provided on the opening portion 23*c* by firmly engaging the protrusions 312*c* of the hanger ring 31*c* in the engagement holes 26 formed around the respective hanger opening 24. Also, at least one tab hole 331 is provided on each of the opening portions 23*c* adjacent to the edge gap 25 thereof Moreover, at least one connecting plug 33*c* is projected from the engagement wing 34. Accordingly, after mounting the hanger rings 31*c* onto the supporting rod through the ring slits 310 and the edge gaps 25, each of the engagement wings 34 can be folded down to the opposite side of the respective opening portion 23*c* and firmly connected with thereto by plugging the connecting plug 33*c* into the tab hole 331 as well as the through hole 313*c* provided on the hanger ring 31 near its ring slit 310.

Figure 9:
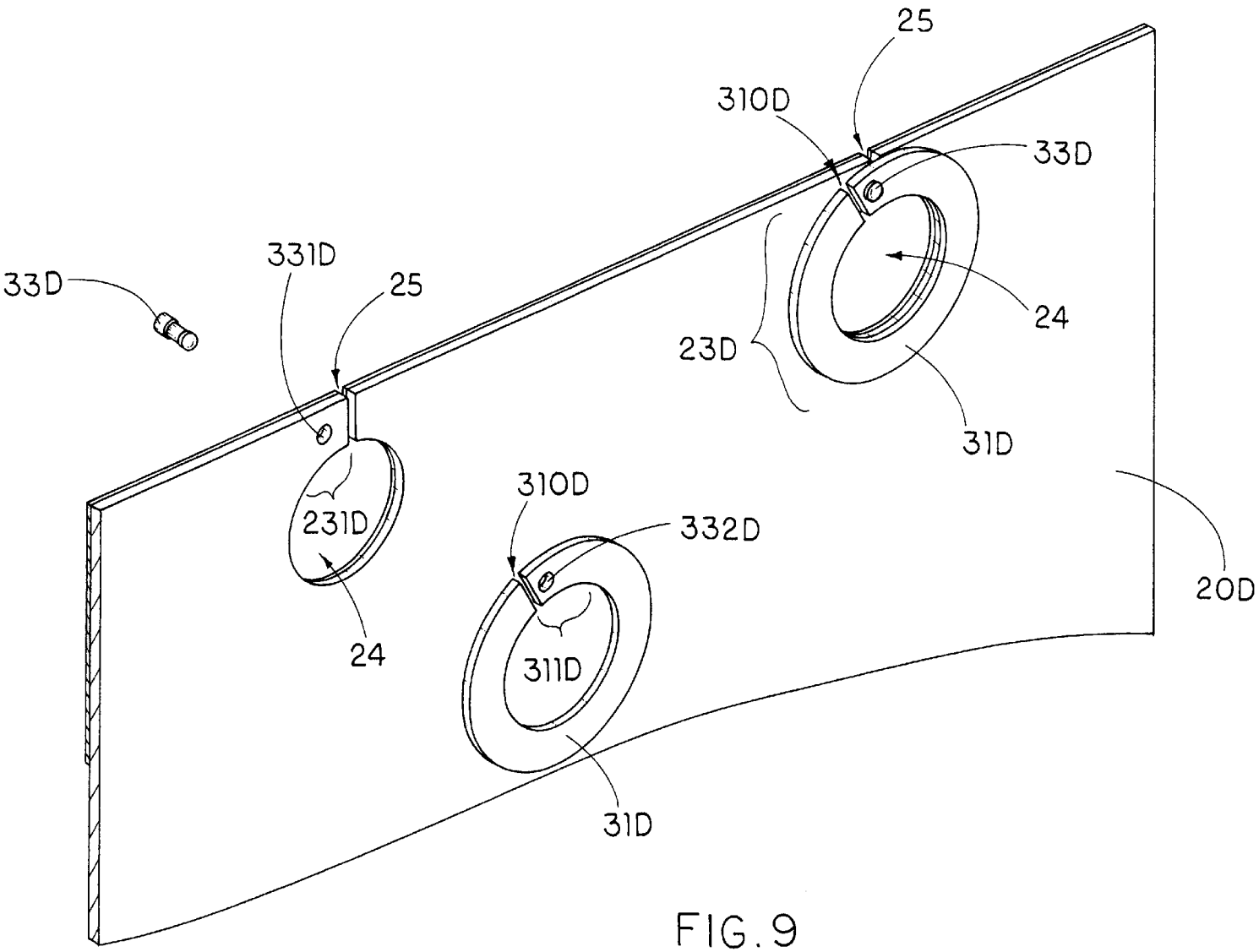
FIG. 9 is an exploded perspective view of a hanger ring assembly according to a fourth preferred embodiment of the present invention.

FIG. 9 illustrates a fourth embodiment of the present invention, in which the hanger rings 31*d* are coaxially glued around the hanger openings 24 provided on the respective opening portion 23*d* of the sheet material 20*d*. The ring slit 310*d* is staggered with the respective edge gap 25. However, a tab hole 331*d* is provided near edge gap 25 and a locking hole 332*d* is provided on the hanger ring 31 near its ring slit 310*d*, wherein each of the tab holes 331*d* is aligned coaxially with the respective locking hole 332*d*, so that a plurality of locking members 33*d*, which can be a pin with enlarged ends, can be used to plug through the respective tab holes and locking holes 332*d* in order to connect the ring tab 311*d* and the connecting tab 231*d* together.

Figure 10:
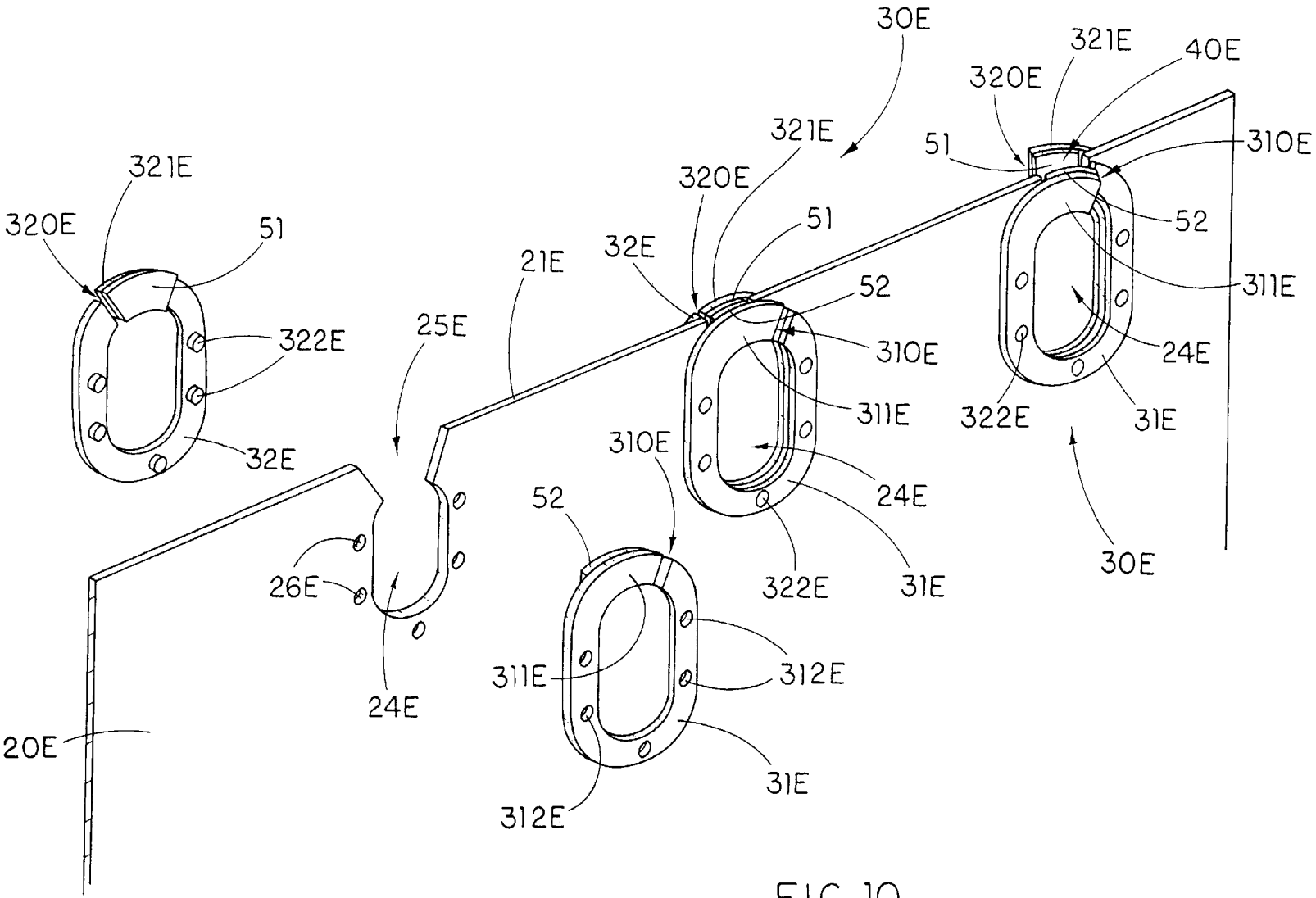
FIG. 10 is a partially exploded perspective view of a hanger ring assembly according to a fifth preferred embodiment of the present invention.

A fifth preferred embodiment is illustrated in FIG. 10, which is a modification of the above first embodiment, wherein the edge gap is modified to form a wide opened edge gap 25*e* extended from the top edge 21*e* of the sheet material 20*e*. A plurality of hanger rings 31*e* are attached on one side of sheet material 20*e* and coaxially positioned around a plurality of hanger openings 24*e* provided on the sheet material 20*e*. Each of the hanger rings 31*e* has a ring slit 310*e* positioned at an upper right side thereof and defines a ring tab 311*e* adjacent to the ring slit 310*e*. A plurality of connecting holes 312*e* are spacedly formed on each of the hanger rings 31*e*. Also, a pluarlity of engagement holes 26*e* are provided around the respective hanger opening 24*e* and aligned with the connecting holes of the hanger ring 31*e*. Each of the engagement rings 32*e* has an end slit 320*e* positioned at an upper left side thereof and defines an engaging tab 321*e* adjacent to the end slit 320*e*. A plurality of protrusions 322*e*, which are spacedly projected from each of the engagement rings 32*e*, are used for enhancing the connection between the engagement rings 32*e* and the hanger rings 31*e* by plugging the protrusions 322*e* through the engagement holes 26 into the connecting holes 312*e*. As mentioned above, by using ultrasonic welding, the hanger rings 31*e* can be united with the engagement rings 32*e* to form an integral ring structure.

The connecting means for each of the hanger units 30*e* can be the means suggested in the preceding embodiments, or as shown in FIG. 10 that comprises a pair of magnetic tabs 51, 52 which are made of flexible sheet like magnetic material, such as magnetic rubber plate. The pair of magnetic tabs 51, 52 are attached to the engaging tab 321*e* of the engagement ring 32*e* and the ring tab 311*e* of the hanger ring 31*e* of each of the hanger units 30*e*. Therefore, by separating apart the pair of magnetic tabs 51, 52 can open the entrance gap 40*e* for mounting onto the supporting rod through the entrance gap 40*e*. The entrance gap 40*e* can be closed by reattaching the pair of magnetic tabs 51, 52 together, wherein the ring tab 311*e* will be firmly connected with the engaging tab 321*e* to form an integral ring structure for hanging the sheet material 20*e* from the supporting rod.

What is claimed is:

1. A curtain adapted for mounting onto a supporting rod, comprising a sheet material, which has a top edge, a plurality of opening portions spacedly formed along said top edge, a plurality of hanger openings provided on said opening portions respectively, and a plurality of edge gaps each extending from said top edge to an upper portion of said respective hanger opening, wherein each of said opening portions defines a section of connecting tab adjacent to said respective edge gap; and a plurality of hanger units each comprising:

a hanger ring which has a ring slit separating two ends thereof and defines a section of ring tab adjacent to said ring slit, wherein each of said hanger rings is attached to one side of said respective opening portion and coaxially extended around said respective hanger opening with said ring slit of said respective hanger ring staggering with said edge gap of said respective opening portion, wherein said connecting tabs of said opening portions of said sheet material are detachably overlapped with said ring tabs of said hanger rings respectively, for enabling said hanger rings mounting onto the supporting rod through said ring slit and said edge gaps respectively, wherein each of said ring slits is a radial through cut from an outer side to an inner side of said respective hanger ring, and said hanger rings are positioned and divided into a plurality pairs of said hanger rings in such a manner that said ring slit of one of said pair of hanger rings is positioned 15° to 30° anticlockwise from vertical, while said ring slit of another of said pair of hanger rings is symmetrically positioned 15° to 30° clockwise from vertical; and means for selectively connecting each of said ring tabs with said respective connecting tab.

2. The curtain as recited in claim 1 wherein a plurality of engagement holes are formed around each of said hanger openings of said opening portions, and each of said hanger rings is provided with a plurality of connection holes which are coaxially aligned with said engagement holes positioned around said respective hanger opening, moreover an inner surface of each of said engagement rings projects a plurality of protrusions aligned coaxially with said connection holes of said hanger rings respectively, wherein by firmly plugging said protrusions of each engagement rings through said engagement holes of said respective opening portion into said connection holes of said respective hanger ring firmly connects said engagement rings and said hanger rings together, so as to more firmly engage and support said sheet material between said hanger rings and said engagement rings.

3. The curtain as recited in claim 2 wherein each of said hanger rings is further united with said respective engagement ring by applying ultrasonic welding to integrally weld said protrusions of said engagement ring with said hanger ring.

4. The curtain as recited in claim 2 wherein said connecting means for each of said hanger units comprises at least one connecting plug protruded from a position near said end slit of said engagement ring and penetrated through said respective opening portion via a tab hole provided near said edge gap, and that each of said hanger rings also symmetrically provides a locking hole on said ring tab thereof, wherein said connecting plugs are adapted to detachably plug into said locking holes respectively so as to rigidly connecting said ring tabs and said connection tabs together to render each of said hanger units becoming an integral ring structure for evenly supporting said sheet material on said supporting rod.

5. A curtain adapted for mounting onto a supporting rod, comprising a sheet material, which has a top edge, a plurality of opening portions spacedly formed along said top edge, a plurality of hanger openings provided on said opening portions respectively, and a plurality of edge gaps each extending from said top edge to an upper portion of said respective hanger opening, wherein each of said opening portions defines a section of connecting tab adjacent to said respective edge gap; and a plurality of hanger units each comprising:

a hanger ring which has a ring slit separating two ends thereof and defines a section of ring tab adjacent to said ring slit, wherein each of said hanger rings is attached to one side of said respective opening portion and coaxially extended around said respective hanger opening with said ring slit of said respective hanger ring staggering with said edge gap of said respective opening portion, wherein said connecting tabs of said opening portions of said sheet material are detachably overlapped with said ring tabs of said hanger rings respectively, for enabling said hanger rings mounting onto the supporting rod through said ring slit and said edge gaps respectively, wherein each of said hanger units further comprises an engagement ring which has an end slit separating two ends thereof, wherein said engagement rings are respectively attached on another side of said opening portions and coaxially aligned with said hanger rings respectively in such a manner that said end slits thereof are respectively aligned with said edge gaps of said opening portions of said sheet material, wherein each of said ring slits is a radial through cut from an outer side to an inner side of said respective hanger ring, and said hanger rings are positioned and divided into a plurality pairs of said hanger rings in such a manner that said ring slit of one of said pair of hanger rings is positioned 15° to 300° anticlockwise from vertical, while said ring slit of another of said pair of hanger rings is symmetrically positioned 15° to 30° clockwise from vertical; and means for selectively connecting each of said ring tabs with said respective connecting tab.

6. The curtain as recited in claim 5 wherein a plurality of engagement holes are formed around each of said hanger openings of said opening portions, and each of said hanger rings is provided with a plurality of connection holes which are coaxially aligned with said engagement holes positioned around said respective hanger opening, moreover an inner surface of each of said engagement rings projects a plurality of protrusions aligned coaxially with said connection holes of said hanger rings respectively, wherein by firmly plugging said protrusions of each engagement rings through said engagement holes of said respective opening portion into said connection holes of said respective hanger ring firmly connects said engagement rings and said hanger rings together, so as to more firmly engage and support said sheet material between said hanger rings and said engagement rings.

7. The curtain as recited in claim 6 wherein each of said hanger rings is further united with said respective engagement ring by applying ultrasonic welding to integrally weld said protrusions of said engagement ring with said hanger ring.

8. The curtain as recited in claim 6 wherein said connecting means for each of said hanger units comprises at least one connecting plug protruded from a position near said end slit of said engagement ring and penetrated through said respective opening portion via a tab hole provided near said edge gap, and that each of said hanger rings also symmetrically provides a locking hole on said ring tab thereof, wherein said connecting plugs are adapted to detachably plug into said locking holes respectively so as to rigidly connecting said ring tabs and said connection tabs together to render each of said hanger units becoming an integral ring structure for evenly supporting said sheet material on said supporting rod.

* * * * *